US005102294A

United States Patent [19]

Hayashi

[11] Patent Number: 5,102,294

[45] Date of Patent: Apr. 7, 1992

[54] SCREW PUMP

[75] Inventor: Akira Hayashi, Tokushima, Japan

[73] Assignee: Hayashi Seiko Co., Ltd., Tokushima, Japan

[21] Appl. No.: 586,498

[22] Filed: Sep. 21, 1990

[30] Foreign Application Priority Data

Sep. 26, 1989 [JP] Japan ..... 1-251333
Jun. 29, 1990 [JP] Japan ..... 2-171667

[51] Int. Cl.[5] ..... F01D 5/00

[52] U.S. Cl. ..... 415/72; 415/73; 415/74; 415/125; 415/220; 416/176; 416/177; 366/299

[58] Field of Search ..... 415/71, 72, 73, 74, 415/125, 250; 416/176, 177; 366/80, 279, 280, 292, 279, 280, 299, 301

[56] References Cited

U.S. PATENT DOCUMENTS 860,712 7/1907 Waddell ..... 415/74
3,676,034 5/1970 Wendricks ..... 415/72 X
4,531,892 7/1985 Nasman et al. ..... 415/71 X
4,772,177 9/1988 Hayashi ..... 415/74
4,960,328 10/1990 Schumacher ..... 366/80
5,025,287 6/1991 Hilbert ..... 366/301 X

*Primary Examiner*—Edward K. Look
*Assistant Examiner*—Todd Mattingly
*Attorney, Agent, or Firm*—David O'Reilly

[57] ABSTRACT

A screw pump for feeding highly viscous material such as mixed concrete and the like. Plural projections engage the helical screw of the screw pumps to facilitating removal of the material such as gravel caught in the screw pump. Further for preventing excessive force from being exerted on the screw because of material caught in the screw pump, a spring is interposed between partitioning plates and hydraulic cylinders or crank mechanisms. Further, to make the position of the holder for the partitioning plate stable, plural rollers are provided above the holders.

33 Claims, 15 Drawing Sheets

SCREW PUMP

FIELD OF THE INVENTION

The present invention relates to a screw pump and more particularly to a screw pump capable of feeding mixed concrete earth and sand, clay or high viscous fluid such as starch syrup or sticky material such as noodles.

BACKGROUND OF THE INVENTION

The inventor of the present invention has proposed in Japanese patent application No. 190051/1986 a screw pump wherein a rotatable helical screw is provided in an outer cylinder, and the outer cylinder is provided with an axially extending longitudinal groove. A plurality of partitioning plates partitions spaces between the shaft of the helical screw and adjacent blades from each other so that material fed by the screw pump is efficiently fed without clogging of the screw pump with the material to be fed, because the pressurized material being fed which sticks on the helical screw is scraped off the partitioning plates.

The above-mentioned partitioning plates are operated by a cam mechanism. However, the screw pump lacks reliability in operation. Further, the screw pump easily breaks, because excessive force is exerted on the screw pump when the space between adjacent partitioning plates and the shaft of the helical screw becomes clogged with foreign matter such as gravel. Further gravel once caught in the screw pump is difficult to remove. Further once trouble such as clogging occurs, repairs and inspections become difficult. If concrete in the screw pump cures during failure of the screw pump, it becomes impossible to restore the apparatus so they are inevitably scrapped.

Further, holders for holding the partitioning plates in such manner that they can be slidably moved are unstable in their positioning or height. As for the screw pump, the partitioning plates are operated by means of a cam mechanism or a cylinder. However, the operation of the partitioning plates cannot be timed with certainty when feeding material by these means and cannot with certainty achieve the desired positioning of the partitioning plates.

BRIEF DESCRIPTION OF THE INVENTION

Accordingly, it is a first object of the invention to provide a screw pump wherein such defects are eliminated and wherein means for facilitating the removal of material such as gravel caught in the screw pump are provided.

A second object of the invention is to provide a screw pump with means for preventing excessive force from being exerted on the screw pump because of material caught in the screw pump.

A third object is to provide a screw pump wherein checks and repairs of the apparatus can be easily performed when trouble caused by material caught in the screw pump occurs.

Still a fourth object of the present invention is to provide a screw pump wherein feeding of material can be performed with exact and secure timing of the operation and positioning of the partitioning plate.

The first object of the invention is achieved with the disclosed screw pump, in the pump of the above-mentioned Japanese patent application comprising: an outer cylinder having a linear central axis, a cylindrical wall, and an axially extending groove formed in the wall. The helical screw extends axially inside the cylinder with drive means for driving the helical screw. A plurality of partitioning plates axially slidably fit in the groove so as to be movable with the helical screw in the direction of the axis of the shaft and are restrained against movement in a direction around the axis. The plurality of partitioning plates are constructed and arranged to engage the helical screw so they can move axially and not rotate when the screw is rotated around its axis. Adjacent sections are partitioned from each other by the partitioning plates to prevent clogging of the pump. According to the invention, the screw pump further comprises plural projections provided on the shaft of the helical screw for removing foreign matters such as gravel caught in the screw at a position opposing a lower end portion of the partitioning plate at an entrance hole portion in the groove of the outer cylinder.

Further, a second object of the invention is attained by the above disclosed screw pump of the above-mentioned Japanese patent application, according to the invention, wherein the screw pump further comprises: revolving chains for moving the partitioning plates in the direction of the axis of the shaft of the helical screw, and holders for holding the partitioning plates so the partitioning plates can slidably move. The holders are each connected to the revolving chains through a connecting means such as a pin. Sliding plates are vertically slidably fitted in the respective holders and connected with a corresponding partitioning plate. The blocks each have a projection or roller and are vertically slidably fitted in a vertical groove formed in the sliding plate. Hydraulic cylinders for vertically moving the respective sliding plates each have a piston connected with said projection or roller through an engaging means and a spring is interposed between the sliding plate and the corresponding block.

In the latter case, a spring interposed between the piston of the hydraulic cylinder and the engaging part can be substituted for the above-mentioned spring interposed between the sliding plate and the corresponding block.

The above-mentioned screw pump preferably has a sealing plate having a trapezoid-shaping opening formed therein for passing the partitioning plate therethrough, with the sealing plate being welded to one end of the holder. A lower surface of the sealing plate is disposed on the outer cylinder so they are capable of sliding on the circumferential edge, in order to maintain the inside of the screw pump at high pressure.

In the present invention, the hydraulic cylinders comprise: a hydraulic cylinder for pushing the partitioning plates into the outer cylinder at the entrance hole portion in the groove of the outer cylinder, with the hydraulic cylinder being mounted on the front side of the partitioning plates and connected with them at the entrance hole portion through the projection or roller and the engaging part. A hydraulic cylinder is also provided by pushing the partitioning plates upward at the exit hole portion in the groove of the outer cylinder. This hydraulic cylinder is mounted on the front side of the partitioning plates and connected with the partitioning plates at the exit hole portion through the projection or roller and the engaging part. Another hydraulic cylinder is provided for pressing the partitioning plates situated midway between the entrance hole portion and the exit hole portion. The pressing hydraulic cylinder is mounted on the front side of the partitioning plates and connected with the partitioning plates situated midway between the entrance hole portion and the exit hole portion through projections or rollers and the engaging parts respectively.

In the disclosed screw pump in the above-mentioned Japanese patent application, according to the invention, the screw pump further comprises: a pair of sprocket wheels mounted on axes of rotation situated on both sides in a direction axial to the outer cylinder; a pair of chains engaging the sprocket wheels, and holders for holding the partitioning plates so that they can be slidably moved. The holders each have a rear portion connected with said pair of chains at the forward side in the direction of progress of the partitioning plates through connecting means; and a guide mounted on the inside of the pair of chains. The guide engages the rear of the holder to control the direction of the pair of chains.

Further, in the present invention, the screw pump preferably has support means for supporting a back side of the holder along the front sides of the chains.

As above-mentioned, according to the present invention, mixed concrete, earth and, clay or viscous fluid such as starch syrup or sticky material such as noodles can be efficiently and securely fed. Further, in the present invention, a plurality of projections for removing gravel caught in the screw pump are provided in plural lines on the shaft of the helical screw at a position facing the lower end of the partitioning plate at the entrance hole portion in a manner such that material such as gravel can be easily removed. Further, since the partitioning plates are operated through a spring, excessive force cannot be applied to them, and all of the partitioning plates can be securely operated by the cylinders. When trouble, such as clogging occurs, all of the electromagnetic valves are operated so that all of the cylinders re raised, allowing the partitioning plates to be pushed up. This makes checks and repairs of the apparatus easy, thereby achieving restoration of the apparatus as quickly as possible.

Further, the fourth object of the invention is attained by the disclose screw pump, in the pump of the above-mentioned Japanese patent application, by a screw pump further comprising holders for holding the partitioning plates so they can be slidably moved and plural rollers provided on upper ends of said holders in a manner such that the partitioning plates can be slidably moved, with a view to pressing down the upper ends of the holders.

The fourth object of the invention is also attained by the disclosed screw pump, in the pump of the above-mentioned Japanese patent application, according to the invention, in which the screw pump further comprises: revolving chains for moving the partitioning plates in a direction of the axis of the shaft of the helical screw. Holders hold the partitioning plates so that they can be slidably moved. The holders are each connected to the revolving chains through a connecting means with the sliding plates each being vertically slidably fitted in the respective holders and connected with the corresponding partitioning plate. Blocks each having a projection or roller are vertically slidably fitted in a vertical groove formed in the sliding plate. Crank mechanisms for vertically moving the respective sliding plates have a piston connected with said projection or roller through an engaging means; and a spring interposed between the sliding plate and the corresponding block.

In the latter case, a spring interposed between the piston of the crank mechanisms and the engaging part can be substituted for the above-mentioned spring interposed between the partitioning plate and the corresponding sliding plate.

Preferably for maintaining the inside of the screw pump at high pressure, there is a sealing plate having a trapezoid-shaped opening formed for passing the partitioning plates therethrough. The sealing plate is welded at one end of the holder, and a lower surface of the sealing plate is disposed on the outer cylinder so it is capable of sliding on the circumferential edge.

In the present invention, the crank mechanisms comprise: a crank mechanism for pushing the partitioning plates into the cylinder at the entrance hole portion in the groove of the outer cylinder. The crank mechanism is mounted on the front side of the partitioning plates and connected with them at the entrance hole portion through the projection or roller and the engaging part. A crank mechanism for pushing the partitioning plate upwardly at the exit hole portion in the groove of the outer cylinder is mounted on the front side of the partitioning plate and connected with the partitioning plate at the exit hole portion through the projection or roller and the engaging part. Another crank mechanism for pressing the partitioning plates situated midway between the entrance hole portion and the exit hole portion, is mounted on the front sides of the partitioning plates and is connected with the partitioning plates situated midway between the entrance hole portion and the exit hole portion through projections or rollers and the engaging parts, respectively.

As above-mentioned, according to the present invention, mixed concrete, earth and sand, clay or viscous fluid such as starch syrup or sticky material such as noodles can be fed efficiently and securely. Further, in the present invention, a plurality of rollers are provided on the upper end of the holder, with a view to pressing down the upper end of the holder. Further, the partitioning plates are operated through a spring, so that excessive force cannot be applied to them. Also the partitioning plates operated by the crank mechanisms make timing of the operation of the partitioning plate and position thereof exact and reliable.

BRIEF DESCRIPTION OF THE DRAWINGS

In the drawings:

FIG. 1(*b*) is an enlarged perspective view of a principal part thereof;

FIG. 1(*c*) is a plan view thereof;

FIG. 1(*d*) is a partial elevation illustrating the chain driven partitioning plates and holder guide;

FIG. 2(*b*) is a packing plate 27 of the embodiment of FIG. 1;

FIG. 2(*c*) is an exploded perspective view of the holder 16 of FIG. 2(*a*);

FIG. 3(*b*) is a block diagram of the embodiment of FIG. 1 with a computer used for control;

FIG. 5(*a*) is a graph showing forward and reverse operation of helical screw 2;

FIG. 5(*b*) is a graph showing a cylinder $CY_1$ for pushing in a partitioning plate;

FIG. 5(*c*) is a graph showing a cylinder $CY_2$ for pushing up a partitioning plate;

FIGS. 5(*d*), 5(*e*), 5(*f*) and 5(*g*) are graphs showing operation with switches L7, L8, L9, L10 on or off;

FIG. 5(*h*) is a graph showing forward and reverse operation of helical screw 2 during abnormal operation;

FIG. 5(*i*) is a graph showing the position of cylinder CY1 for pushing in of a partitioning plate during abnormal operation;

FIG. 5(*j*) is a graph showing the position of cylinder CY2 for pushing up a partitioning plate during abnormal operation;

FIG. 5(*k*) and 5(*l*) are a graph showing the on and off condition switches 17, 18 during abnormal operation.

FIG. 6(*b*) is an enlarged perspective view of the principal part thereof;

FIG. 6(*c*) is a plan view thereof;

FIG. 6(*d*) is a front view of a principal part of a crank mechanism;

DETAILED DESCRIPTION OF THE INVENTION

Figure 1A:
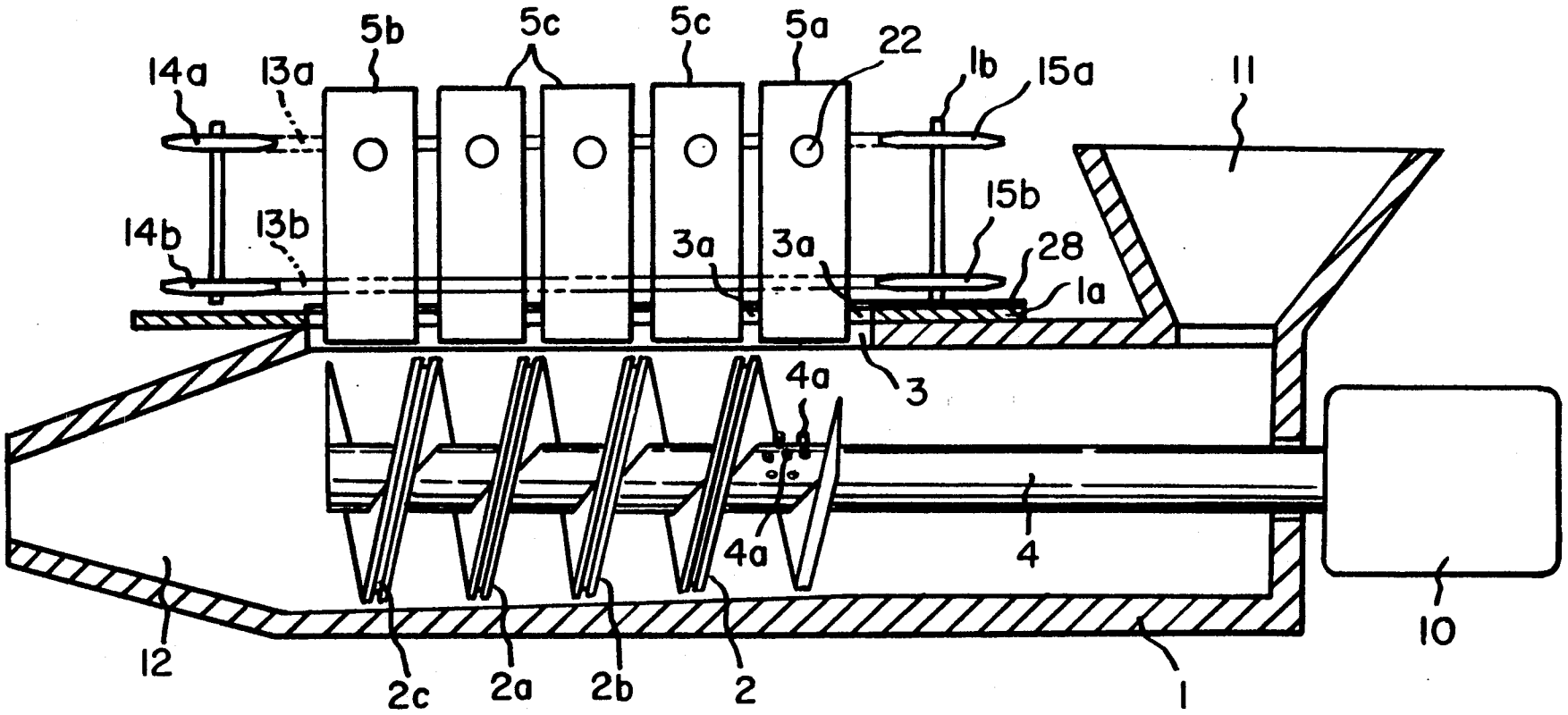
FIG. 1(*a*) is a vertical section of one embodiment of the present invention.
Figure 1B:
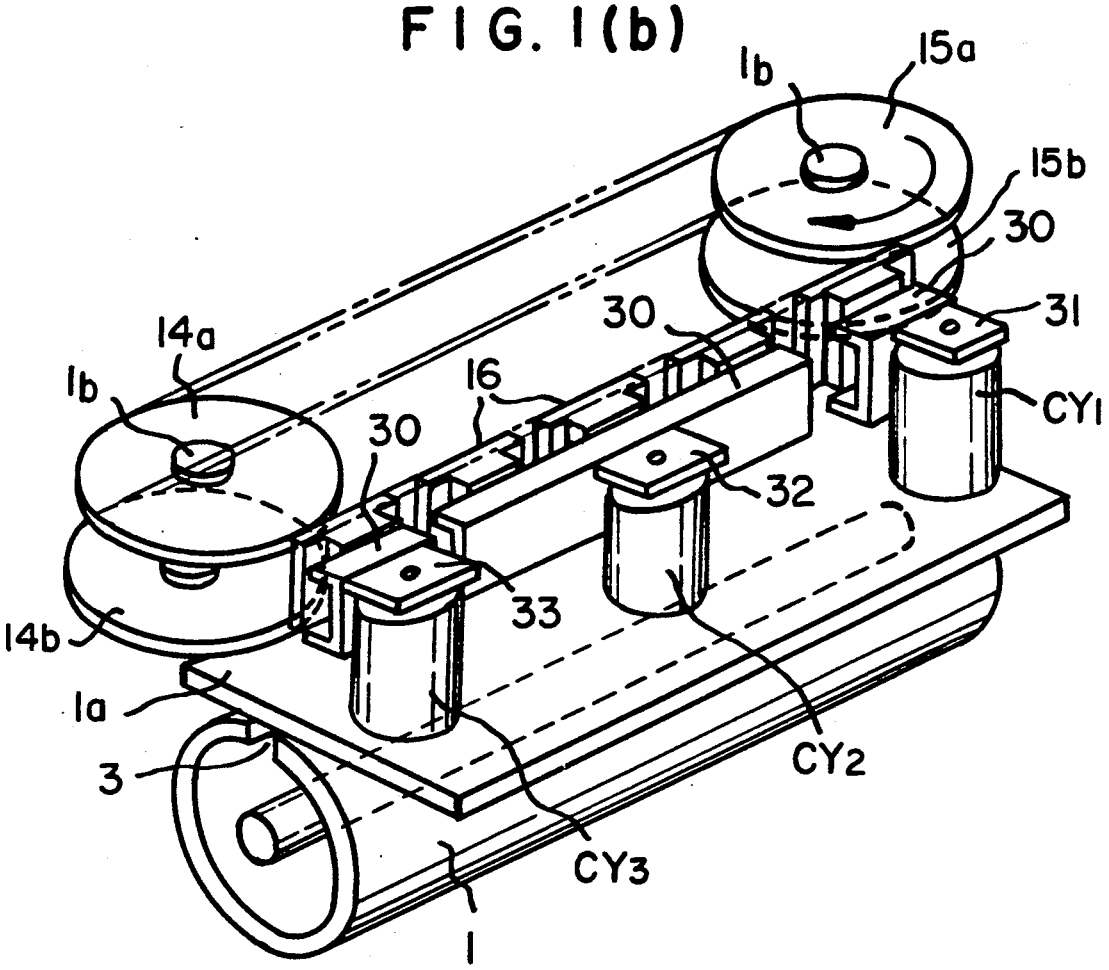

Referring to FIG. 1(*a*), a screw pump has an outer cylinder 1 with a longitudinal groove 3 extending axially in a cylindrical wall of outer cylinder 1. Helical screw 2 is provided to revolve in the outer cylinder 1 and a plurality of partitioning plates 5 (5*a* through 5*c*) are provided in longitudinal groove 3 and are slidably movable in the direction of the axis of the outer cylinder 1 in the longitudinal groove 3, to partition spaces between the cylindrical surface of the helical screw shaft 4 and adjacent blade sections 2*a*, and 2*b* of the screw 2 from each other.

Figure 2B:
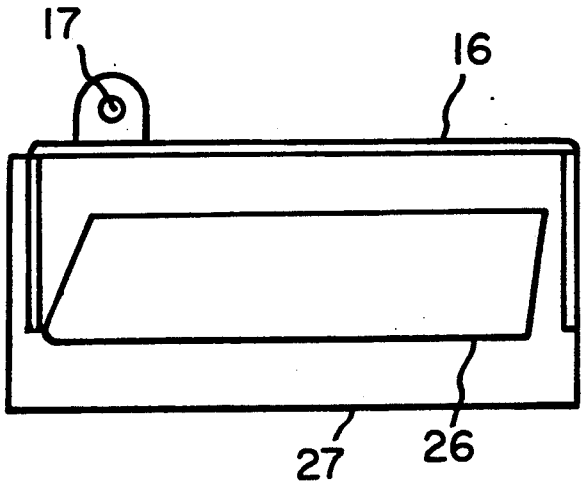
FIG. 2(*a*) is a perspective view of a holder 16 of the embodiment of FIG. 1.
Figure 1C:
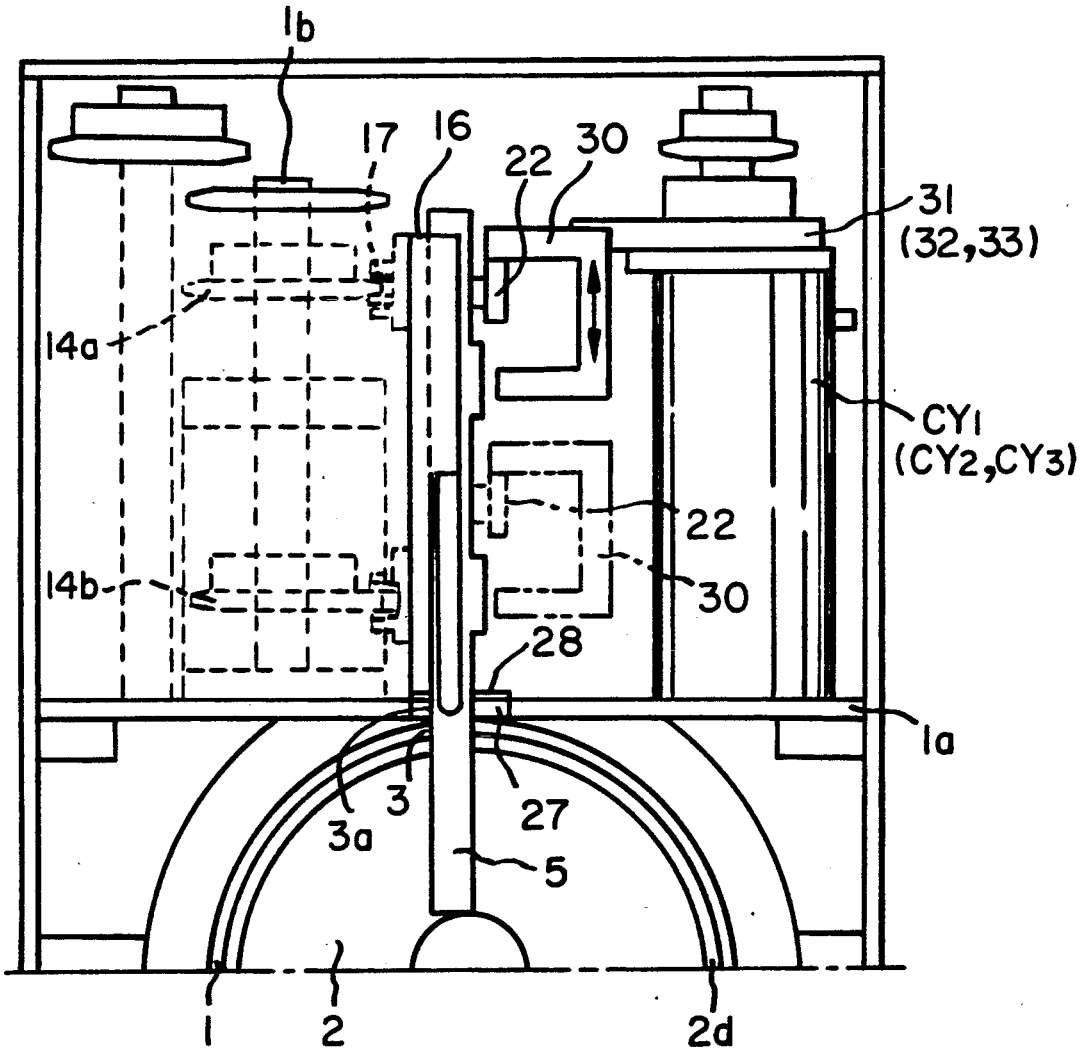
Figure 1D:
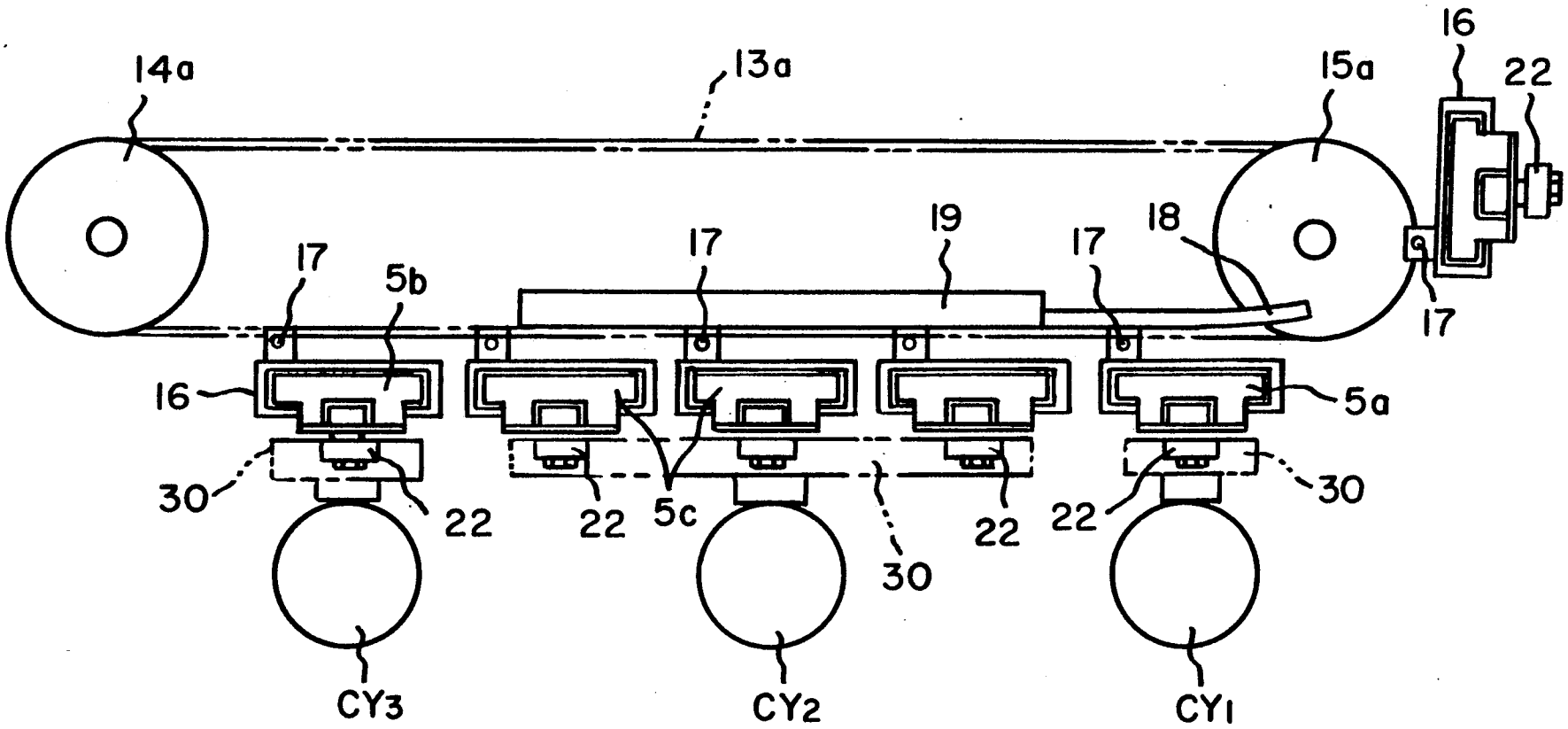
Figure 2A:
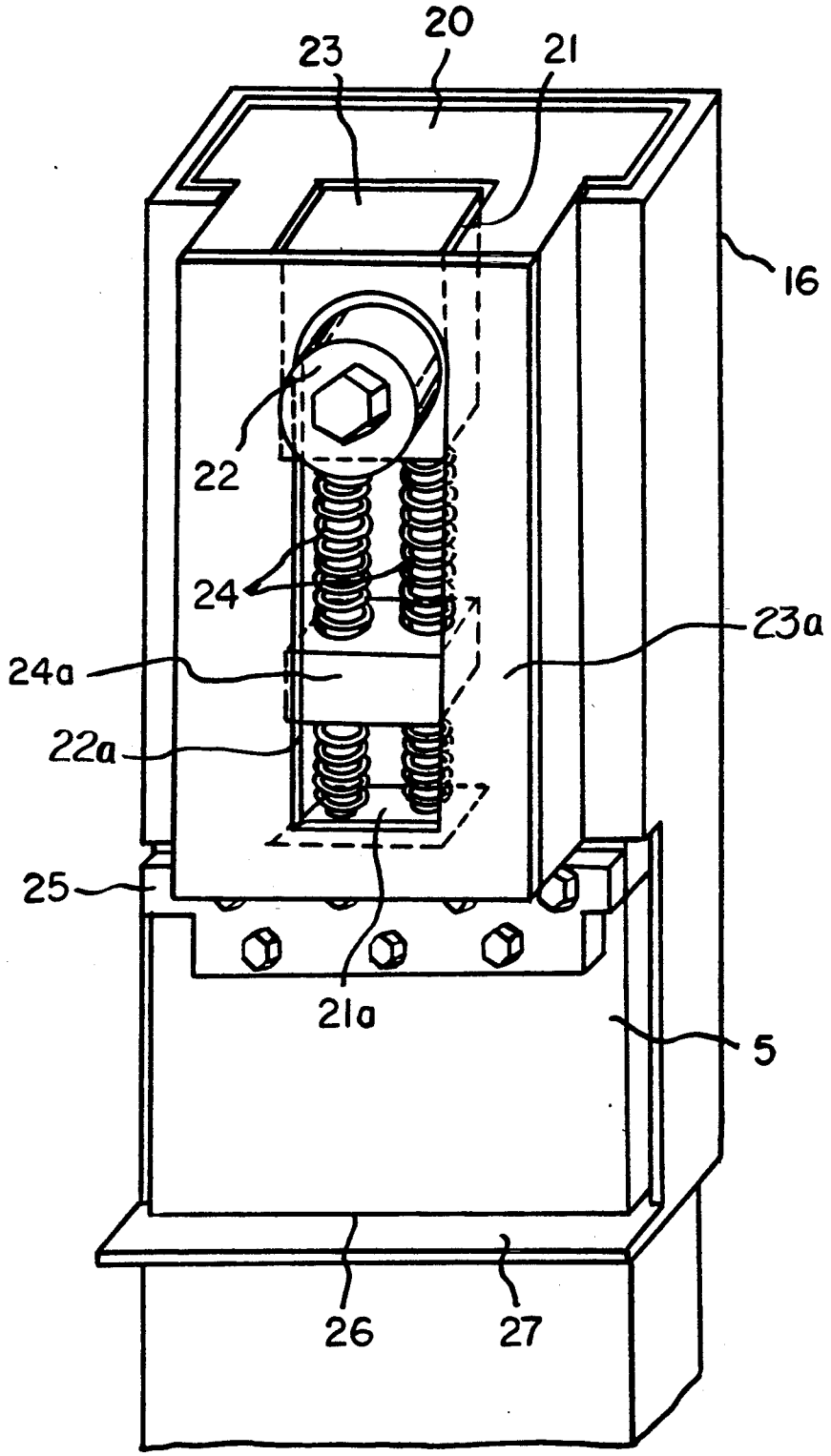
Figure 2C:
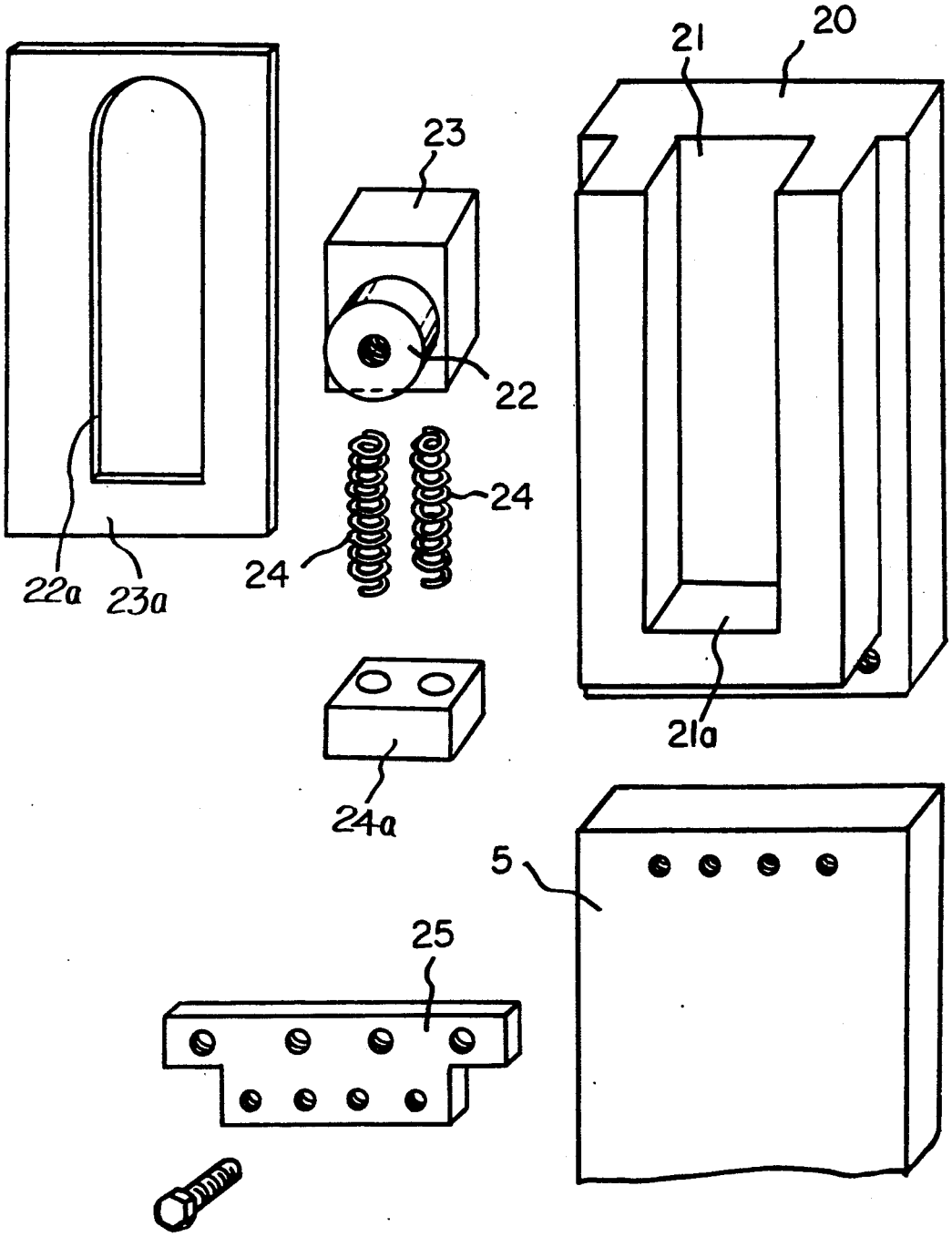

A packing 2*d* (FIG. 2 (*c*)) is put in packing groove 2*c* formed at a peripheral portion of helical screw 2 for sealing between the peripheral helical screw and the inner wall of outer cylinder 1.

In FIG. 1(*a*), motor 10 drives helical screw 2. Outer cylinder 1 has an inlet hopper 11, and an outlet 12.

In the above apparatus, when the helical screw 2 and shaft 4 rotate, partitioning plates 5, are pressed by helical screw 2 to slidably move the axial direction of outer cylinder 1. Partitioning plates 5, 5*a*, 5*b*, 5*c* partition a space helically extending in helical screw 2 into plural sections, in which each partitioned section moves forward with rotation of helical screw 2. Each of the partitioning plates 5 scrapes off pressurized material being fed which has stuck to helical screw 2. Therefore, the screw pump is free of clogging, thus efficiently feeding material.

As shown in FIG. 1(*b*), base 1*a* is arranged above the outer cylinder 1, on which rotatably bears the axes of rotation 1*b*, 1*c* on both ends of the base 1*a*. Upper and lower sprocket wheels 14*a*, 14*b* and 15*a*, 15*b* are mounted on and turn on rotation axes 1*b*, 1*c* respectively. A pair of upper and lower chains 13*a*, 13*b* are horizontally engage upper and lower sprocket wheels 14*a*, 14*b*, and 15*a*, 15*b*. Upper and lower chains 13*a*, 13*b* are connected with upper and lower parts on the back side of each partitioning plate holder 16, with pins 17, on the forward side thereof as shown in FIG. 2. Longitudinal groove 3*a* provided in base 1*a* contacts with longitudinal groove 3.

As shown in FIG. 1(*d*), guide 18 adjusts the direction of holder 16 toward the direction of chains 13 by engaging the back side of holder 16, and supporting means 19 for supporting the back side of holder 16 are achieved to the inside chains 13.

As shown in FIGS. 2(*a*) and 2(*b*), holders 16, are holding plates having a C-shaped cross-section extending in a vertical direction and are made of iron. Sliding plates 20 are made of cast nylon and engaged insides of holders 16, so as to be movable in a vertical direction. Further sliding plates 20 are provided with a vertical groove 21 therein. Vertical groove 21 engages block 23, having projection or roller 22, and is movable in a vertical direction. Retaining plates 23*a* in a vertical groove with slot 22*a* guide roller 22. Between the under surface of block 23 and bottom 21*a* of vertical groove 21, a pair of compression springs, 24 and spring guide 24*a* are inserted.

The lower ends of sliding plates 20 are connected with polyurethane partitioning plates 5, through connecting means 25. The lower end of holder 16 is welded to sealing plate 27 having a trapezoidal shaped opening 26 (FIG. 2(*b*)) for closely passing the lower end of partitioning plate 5 through the sealing plate. The lower surface of sealing plate 27 comes into close contact with packing 28 (FIG. 1(*a*)) made of urethane rubber around the upper surface of the longitudinal groove 3 so as to be slidably movable on packing 23. Sealing plate 27 seals outer cylinder 1, so that the inside of outer cylinder 1 can be maintained at a high pressure.

As shown in FIGS. 1(*a*), 1(*b*), 1(*c*) and 1(*d*), the front side of partitioning plate in and has piston 31 engaging partitioning plate 5*a* at the entrance hole portion through roller 22 and C-shaped engaging part 30. Hydraulic cylinder $CY_2$ for pushing up partitioning plates piston 32 engages partitioning plates 5*c* at the exit hole portion through rollers 22 and C-shaped engaging part 30. Hydraulic cylinder $CY_3$ for pressing the partitioning plates has piston 33 engaging partitioning plates 5*b* therebetween through roller 22 and C-shaped engaging part 30; all of which are arranged on base 1*a*. Springs 24 can be mounted between pistons 31, 32, 33 of hydraulic cylinders $CY_1$, $CY_2$, $CY_3$, instead of being mounted between blocks 23 and partitioning plates 5.

Figure 3A:
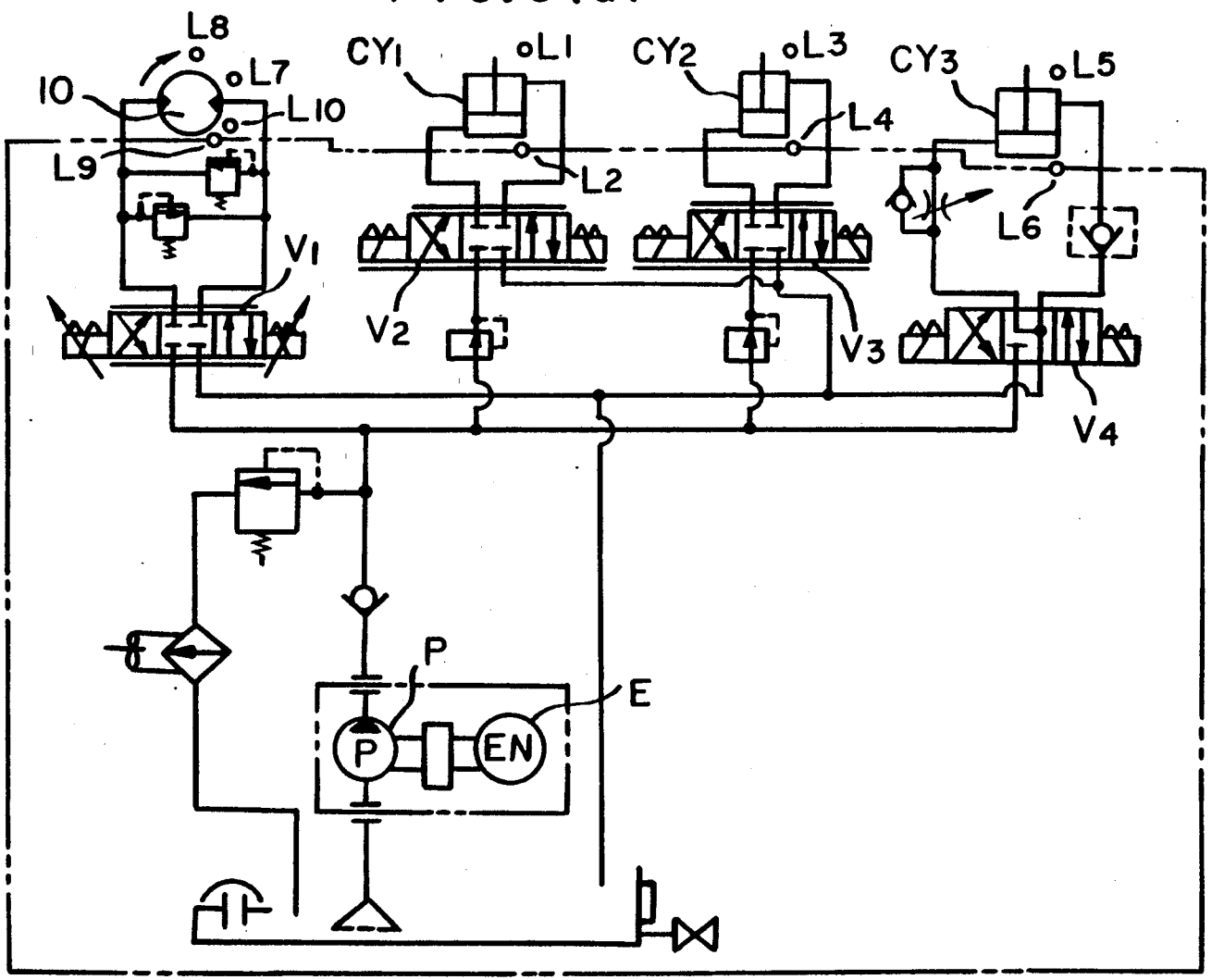
FIG. 3(*a*) is a hydraulic circuit of the drive of the embodiment of FIG. 1.
Figure 3B:
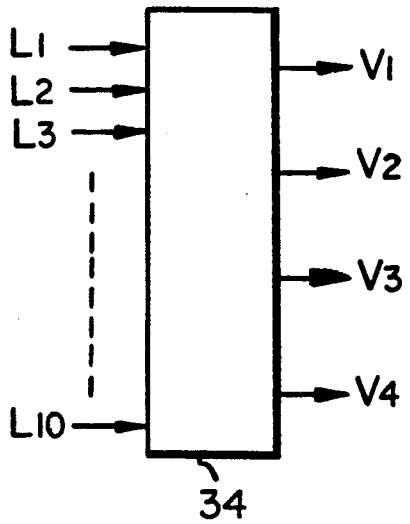
Figure 6B:
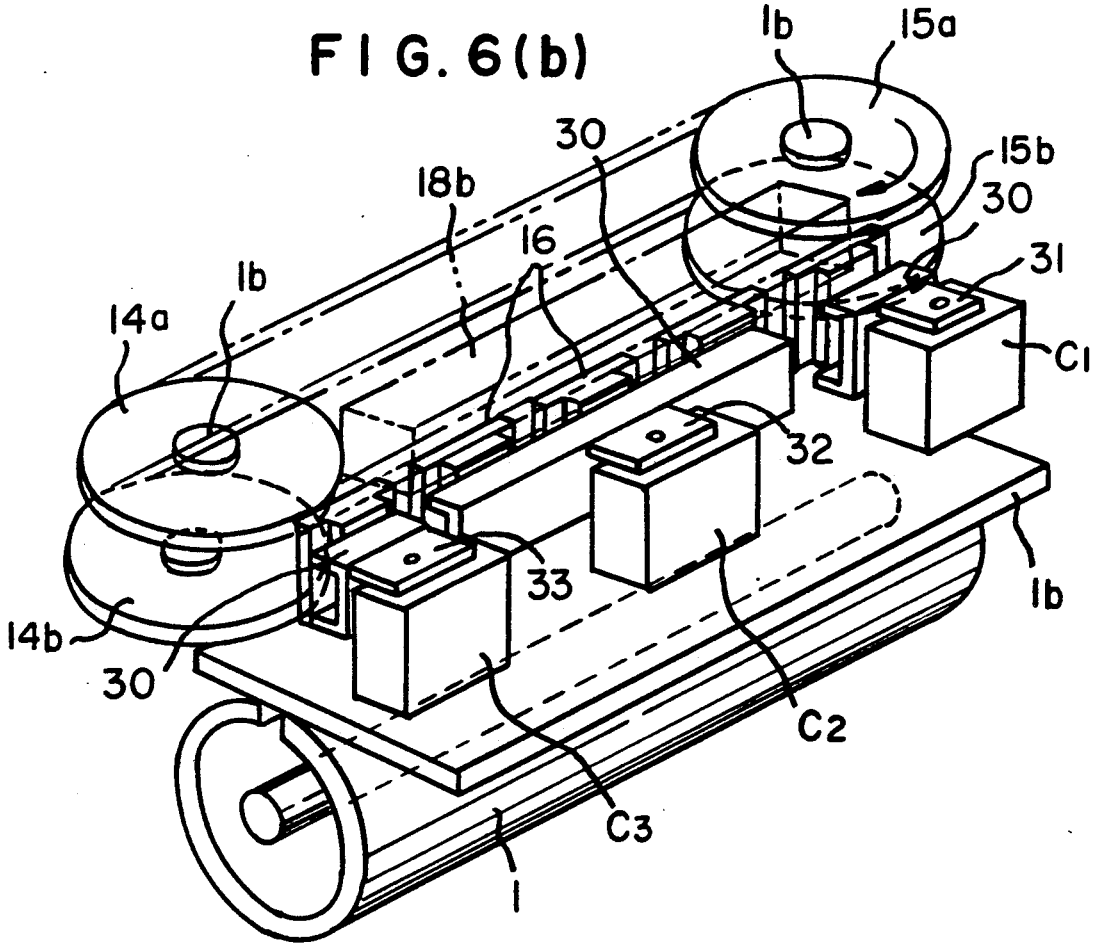
FIG. 6(*a*) is a vertical section of an example of the present invention.

FIG. 3(*a*) shows a hydraulic circuit for driving hydraulic cylinders $CY_1$, $CY_2$, $CY_3$. Pump P is driven by engine E. Pump P is connected through electromagnetic valves $V_1$, $V_2$, $V_3$, $V_4$ with motor 10 and hydraulic cylinders $CY_1$, $CY_2$, and $CY_3$.

Switches $L_1$, and $L_2$ of detectors detect the upper and lower ends of cylinder $CY_1$. Switches $L_3$ and $L_4$ of the detectors detect the upper and lower ends of cylinder $CY_2$. Switches $L_5$ and $L_6$ of detectors that detect the upper and lower ends of cylinder $CY_3$. Switches $L_7$, $L_8$, $L_9$, $L_{10}$ of detectors detect the rotating direction of helical screw 2.

A control for controlling helical screw 2 and cylinders $CY_1$, $CY_2$, and $CY_3$ may be either computer 34 as shown in FIG. 3(*b*), or a sequence circuit.

Figure 4:
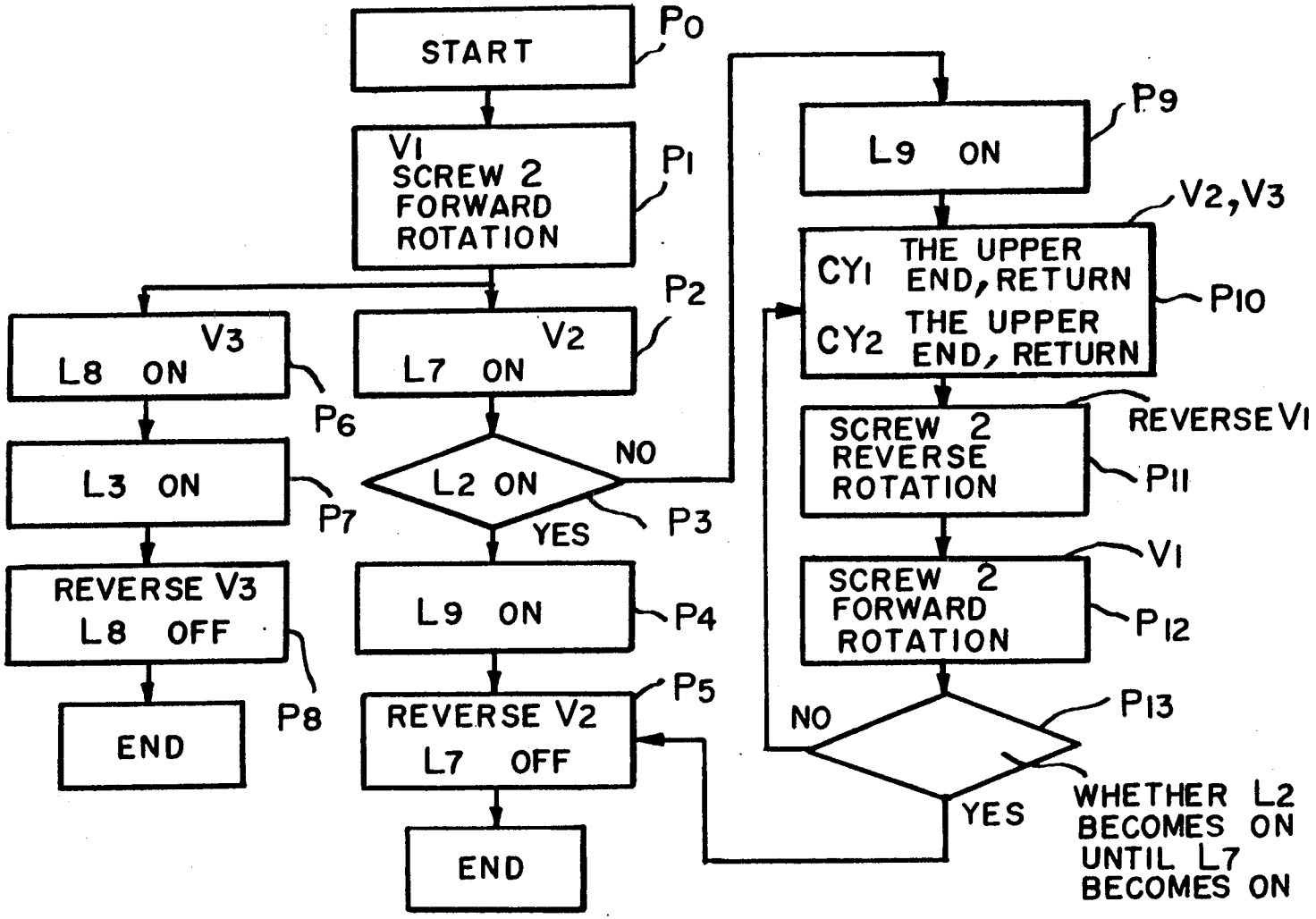
FIG. 4 is a flow diagram of the embodiment of FIG. 1.

Operation of the apparatus is explained by referring to the flow sheet as shown in FIG. 4.

When the apparatus starts at step $P_0$, electromagnetic valve $V_1$, works at a step $P_1$ so that helical screw 2 is rotated by pump P. When switch $L_7$ turns on at step $P_2$, electromagnetic valve $V_2$ works so that cylinder $CY_1$ lowers partitioning plate 5a. Then when switch $L_3$ turns on at step $P_3$, the process of pushing partitioning plate 5a by cylinder $CY_1$ is completed. Further, when switch $L_3$ turns on in step $P_4$, and switch $L_3$ turns off in step $P_5$, electromagnetic valve $V_2$ works in the opposite direction so that the cylinder $CY_1$ returns to its original position.

On the other hand, when step $P_1$ is followed by step $P_6$ in which switch $L_8$ turns on, electromagnetic valve $V_3$ works so that cylinder $CY_9$ is raised, thereby partitioning plate 5b at the exit hole portion is pushed up. When switch $L_9$ turns on in step $P_7$, pushing-up partitioning plate 5b by cylinder $CY_2$ is completed. Further when switch $L_8$ turns off, electromagnetic valve $V_3$ works in the opposite direction so that cylinder $CY_2$ returns to its original lower position.

The normal operation is as aforesaid.

When a space between the lower end of partitioning plate 5a at the entrance hole portion and shaft 4 becomes clogged with material such as gravel, switch $L_2$ does not turn on but switch $L_3$ turns on in step $P_9$. Electromagnetic valve $V_2$ and $V_3$ work in step $P_{10}$ so that cylinders $CY_1$, and $CY_2$ return to the upper position, and electromagnetic valve $V_1$ works in the opposite direction in step $P_{11}$ so that the helical screw 2 is reversed by 5° to move backward.

Helical screw 2 then moves forward is step $P_{12}$. Further material caught in the screw pump such as gravel is delivered in step $P_{13}$ and until switch $L_9$ and switch $L_2$ turn on, and the operation returns to step $P_3$ the operation becomes normal. However, when the operation does not return to such a state, the operation returns to step $P_{10}$ so that an abnormal condition of operation is maintained.

Figure 5:
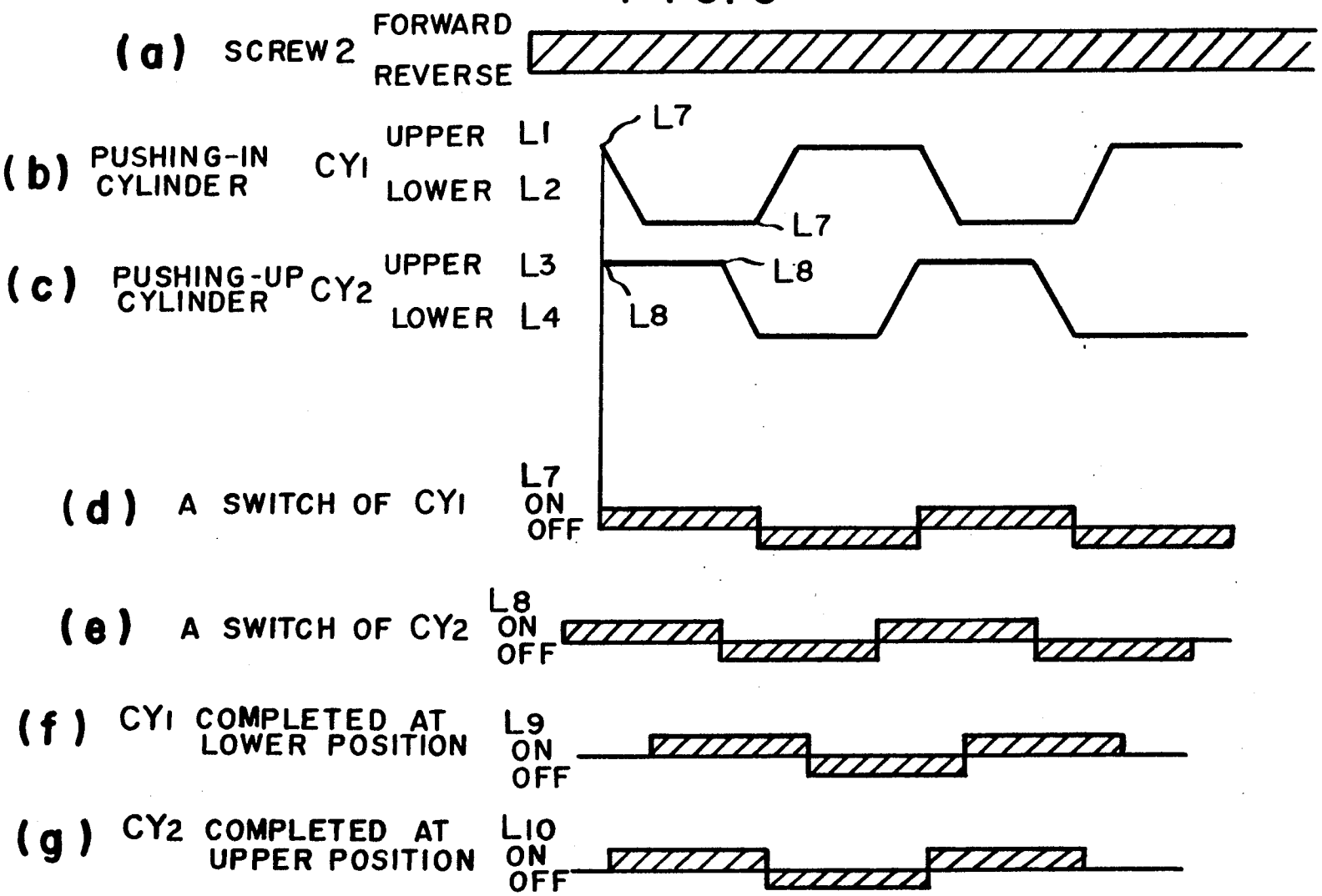
FIG. 5(*a*) through 5(*l*) are graphs showing conditions of operation of the above-mentioned individual parts.
Figure 5:
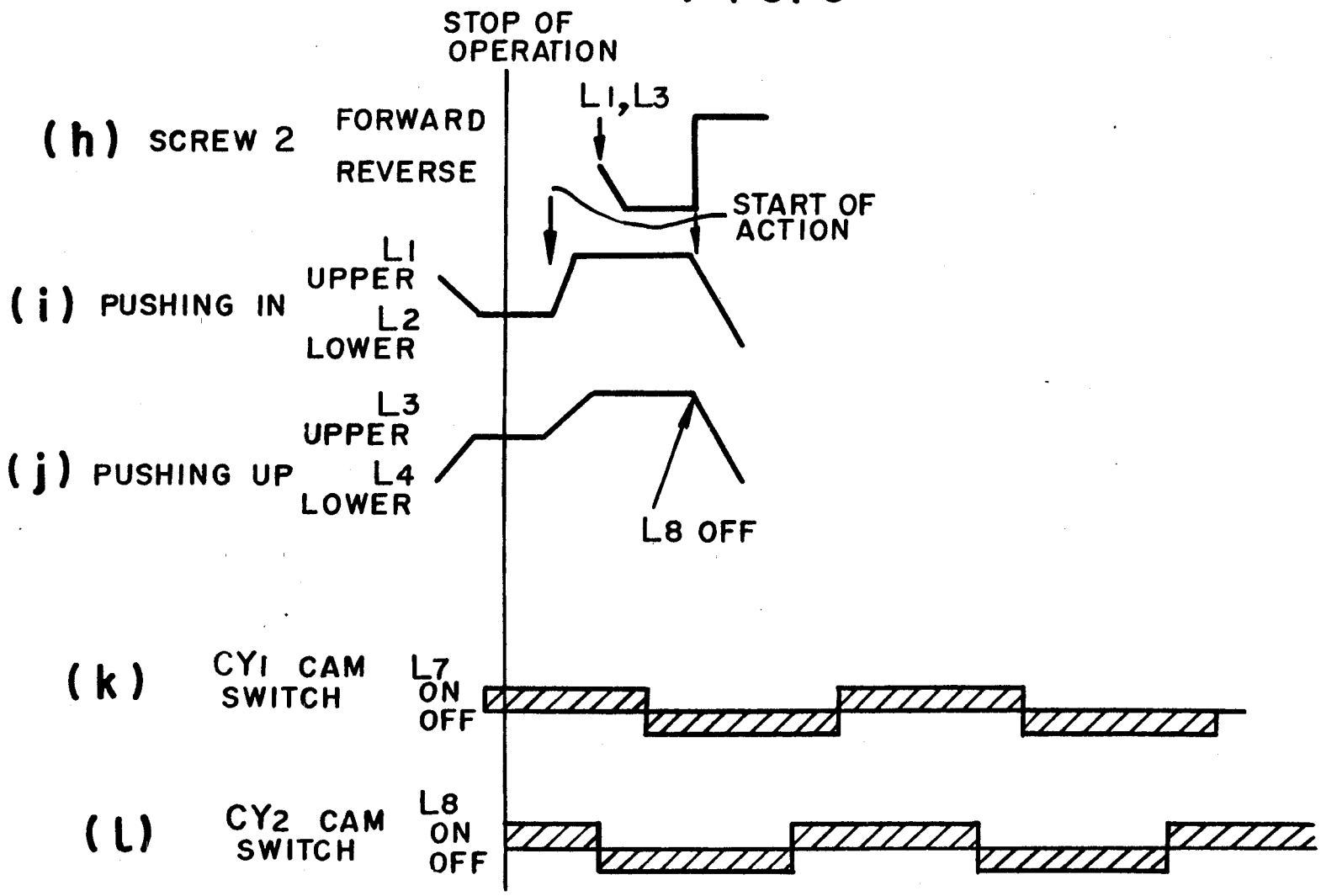
Figure 6A:
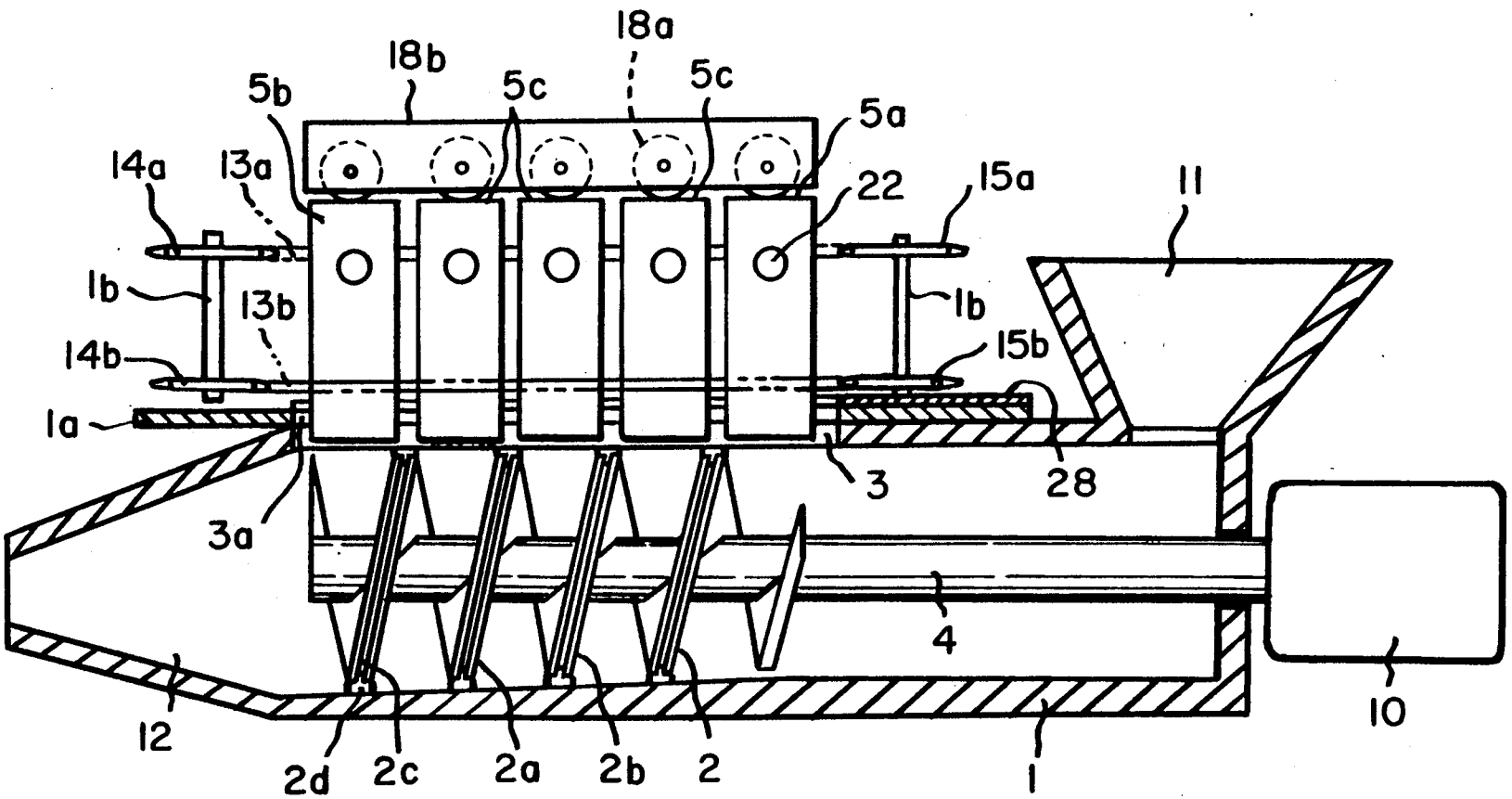
Figure 6C:
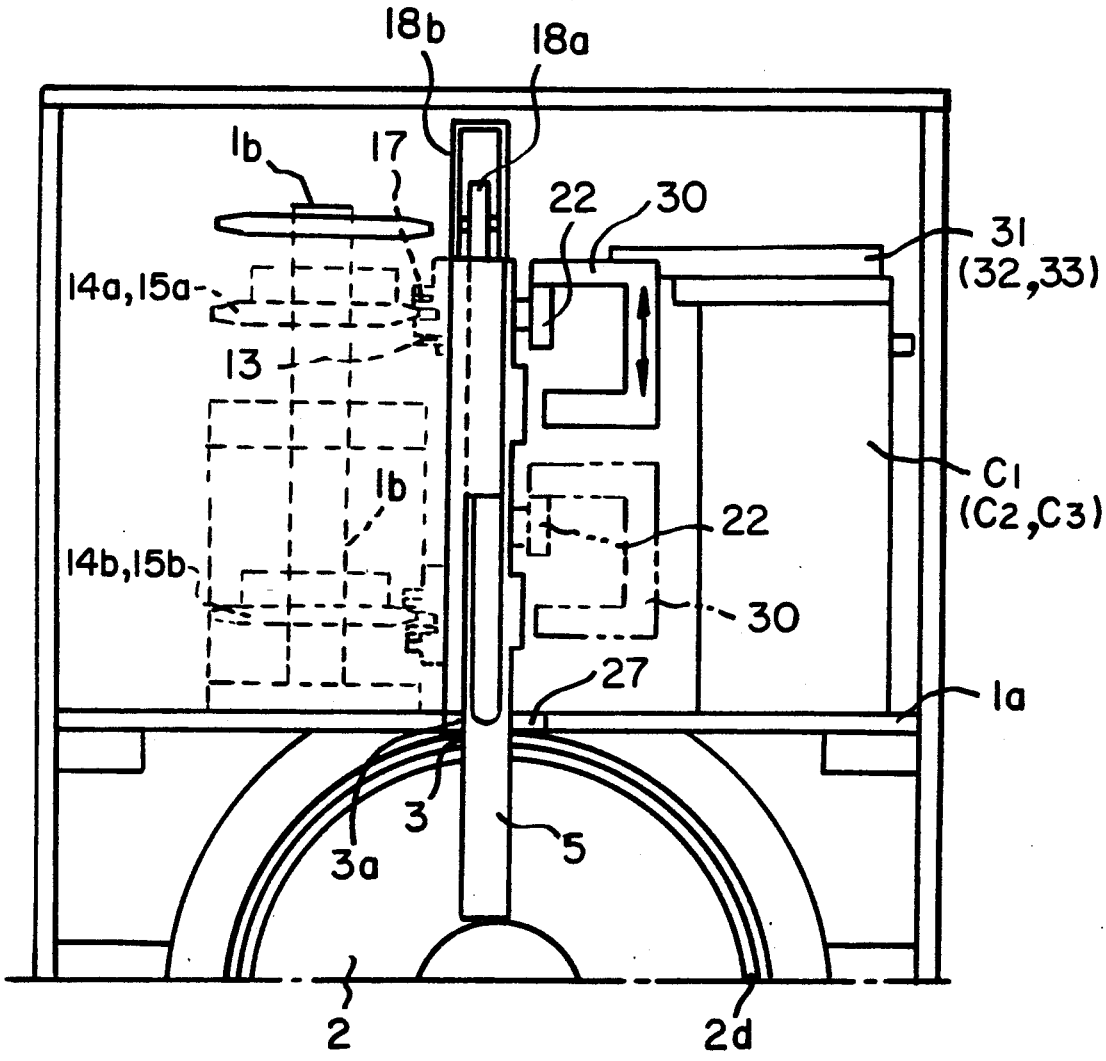
Figure 6D:
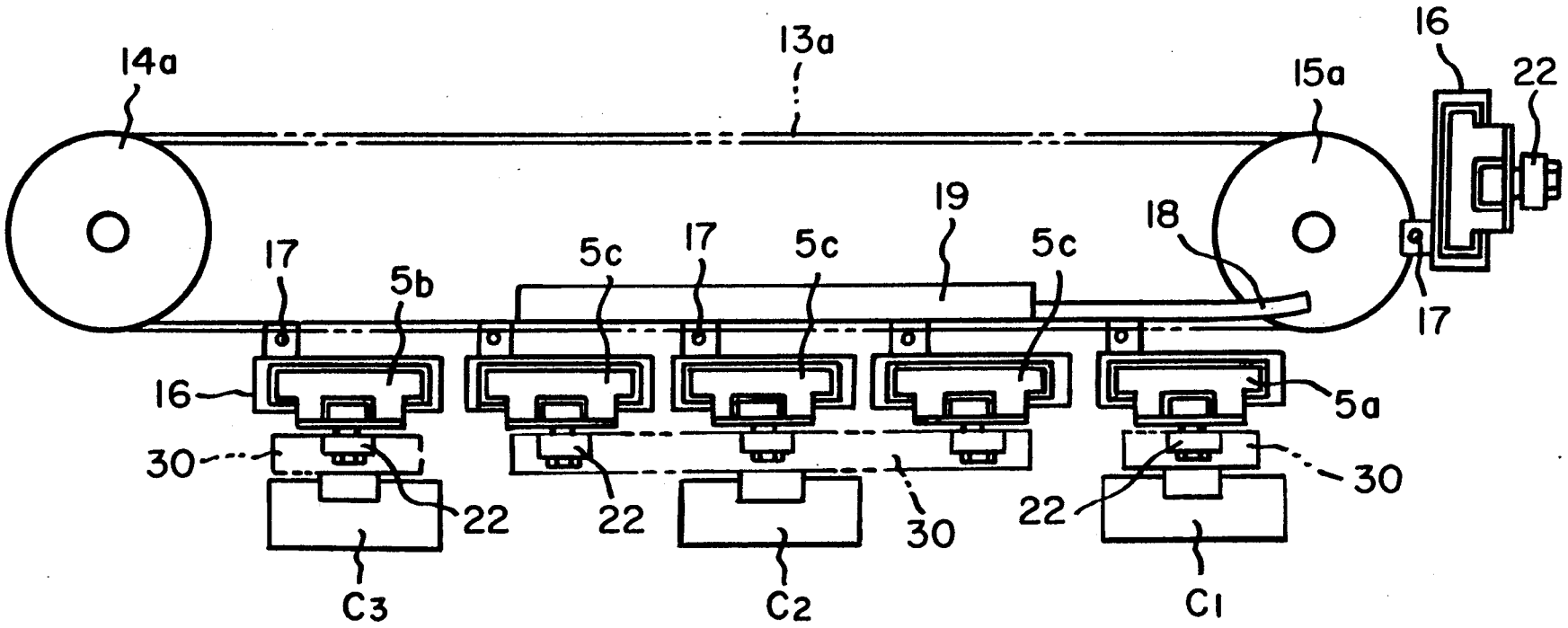
Figure 6E:
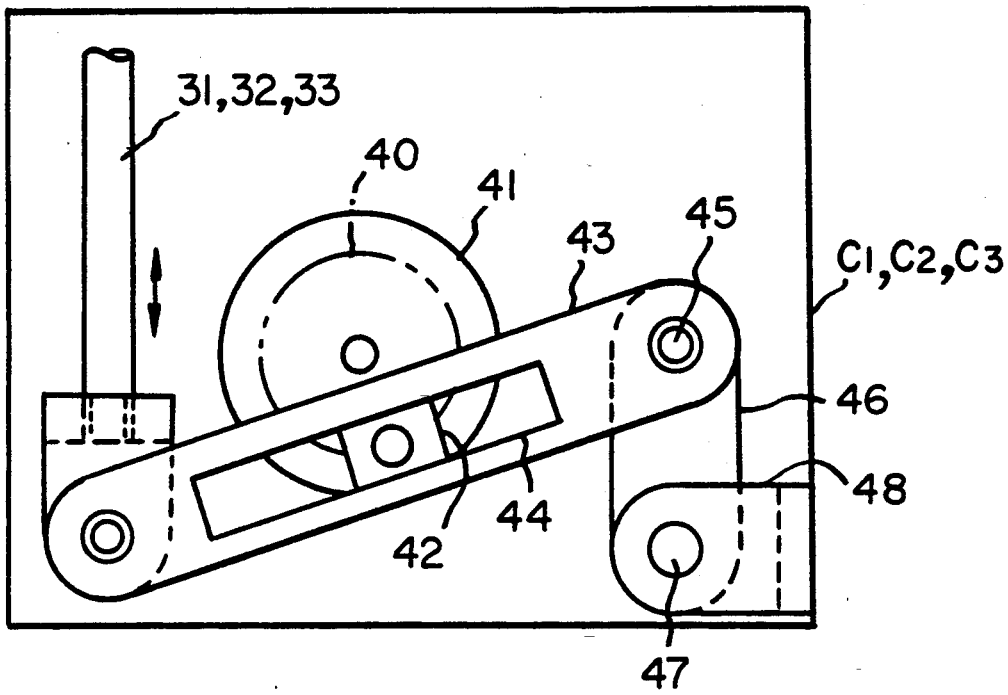

FIGS. 5(*a*) through 5(*l*) are graphs showing the condition of operation of the above-mentioned individual parts. FIG. 5(*a*) is a graph showing forward and reverse rotation of helical screw 2. FIG. 5(*b*) is a graph showing the position of the cylinder for pushing on the partitioning plate, FIG. 5(*c*) is a graph showing the position of the cylinder for pushing a partitioning plate up. FIGS. 5(*d*), 5(*e*), 5(*f*) and 5(*g*) are graphs showing the on and off condition of switches $L_7$, $L_8$, $L_9$, and $L_{10}$. FIG. 5(*h*) is a graph showing the forward and reverse operation of helical screw 2 during abnormal operation while FIG. 5(*i*) is a graph showing the position of cylinder $CY_1$ for pushing in the partitioning plate during abnormal operation. FIG. 5(*j*) is a graph showing the position of cylinder $CY_2$ for pushing the partitioning plate up during abnormal operation, and FIGS. 5(*k*) and 5(*l*) are graphs showing the on and off state of switches 17 and 18 during abnormal operation.

As shown in FIG. 1(*a*), a plurality of projections 4a, 4a, for removing material caught in the screw pump such as gravel are provided in plural lines on the shaft of helical screw 2 at positions facing the lower end of the partitioning plate 5a at the entrance hole portion. These projections 4a, assure removal of material caught in the screw pump, such as gravel during an abnormal condition.

When trouble, such as clogging, occurs during operation of the above-mentioned apparatus, all of electromagnetic valves $V_2$, $V_3$, and $V_4$ operate, thereby all cylinders $CY_1$, $CY_2$, and $CY_3$ rise so that all partitioning plates 5 are pushed up. This makes checking and repair of the apparatus easy, thereby suitable restoration of the apparatus is possible.

Another embodiment is explained by referring to FIG. 6(*a*). A screw pump is comprised of an outer cylinder 1 having longitudinal groove 3 extending axially on a wall of the outer cylinder 1. Helical screw 2 is rotatable in outer cylinder 1 and a plurality of partitioning plates 5 are provided in longitudinal groove 3 so as to be slidably movable in the direction of the axis of outer cylinder 1, for partitioning spaces between adjacent blade sections 2a, and 2b of helical screw 2 from each other and the cylinder surface of helical screw shaft 4.

Packing 2d is put in packing groove 2c formed at a peripheral portion of helical screw 2 for sealing between the peripheral portion of the screw and an inner wall of outer cylinder 1.

In FIG. 6(*a*), motor 10 drives helical screw 2. Outer cylinder 11 has an inlet hopper 11 and an outlet 12.

As shown in FIG. 6(*b*), base 1a is arranged above outer cylinder 1, and rotatably bears axes of rotation 1b on both ends of base 1a. Upper and lower sprocket wheels 14a, 14b, and 15a, 15b are mounted on axis of rotation 1b for rotation. A pair of upper and lower chains 13a, 13b horizontally engaged upper and lower sprocket wheels 14a, 14b and 15a, 15b. Upper and lower chains 13a, 13b are connected with upper and lower parts of the back side of each partitioning plate holder 16 by pins 17 on the forward side thereof as shown in FIG. 6(*c*). Longitudinal groove 3a provided in base 1a connects with longitudinal groove 3.

As shown in FIG. 6(*a*), plural rollers 18a are provided in a box-shaped frame above holders 18b. As shown in FIG. 6(*d*), guide 18 for adjusting the direction of holder 16 toward the direction of chains 13 by engaging the back side of holder 16, and a supporting means 19 for supporting the backs side of holder 16 are secured to the inside of chains 13.

The holders are as above-mentioned with reference to FIGS. 2(*a*) and 2(*b*). As shown in FIGS. 2(*a*) and 2(*b*), holders 16 are holding plates having a C-shaped cross-section extending in a vertical direction and made of iron. Sliding plates 20 made of cast nylon engage with the insides of holders 16 and are movable in a vertical direction. Further sliding plates 20 are provided with vertical groove 21. Vertical groove 21 engages block 23 having a projection or roller 22 to be movable in a vertical direction. Between the under surface of block 23 and bottom 21a of the vertical groove 21a, a pair of compression springs 24 are inserted.

The lower ends of sliding plates 20 are connected with polyurethane partitioning plates 5, through connecting means 25. The lower end of holder 16 is welded to sealing plate 27 having trapezoidal shaped opening 26 for closely passing the lower end of each partitioning plate 5 through the sealing plate. The lower surface of sealing plate 27 comes into close contact with packing 28 made of urethane rubber around the upper surface of longitudinal groove 3 so as to be slidably movable on packing 28. Sealing plate 27 seals outer cylinder 1, so that the inside of the outer cylinder 1 can be maintained at a high pressure.

As shown in FIGS. 6(*b*) and 6(*c*), on the front side of partitioning plate 5, crank mechanism $C_1$ having a piston 31 for pushing partitioning plate in, engages partitioning plate 5a at the entrance hole portion through roller 22 and C-shaped engaging part 30. Crank mechanism $C_2$ for pushing up the partitioning plate, having a piston 32 engages partitioning part 5b at the exit hole portion through roller 22 and C-shaped engaging part 30. Crank mechanism $C_3$ for pressing the partitioning plates, having a piston 33, engages partitioning plates 5*c* situated midway between the entrance hole portion and the exit hole portion through roller 22 and C-shaped engaging part 30 and are arranged on base 1*a*. Springs can be mounted between pistons 31, 32, 33 of crank mechanisms $C_1$, $C_2$, $C_3$, instead of springs 24 mounted between block 23 and each partitioning plate 5.

FIG. 6(*e*) shows an example of crank mechanisms $C_1$, $C_2$, $C_3$. The crank mechanism comprises crank disk 41 rotated by driving mechanism 40. Crank pin 42 is rotatably supported in crank disk 41, which engages long hole 44 formed in crank lever 43. One end of crank lever 43 is connected through pin 45, link 46 and pin 47 with fixed part 48. The other end of crank lever 43 is connected with pistons 31, 32, 33 guided in a vertical direction in the outer cylinder.

Figure 7:
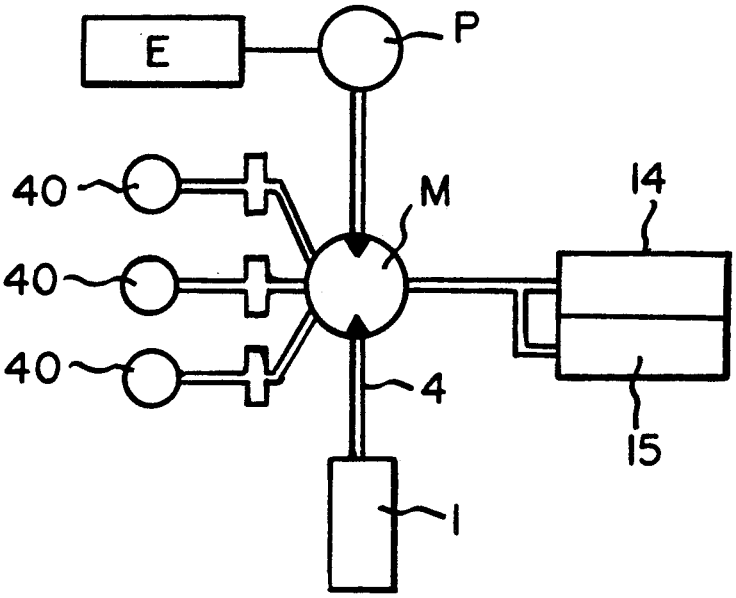
FIG. 7 is a hydraulic circuit for the drive of the embodiment of FIG. 1.

The operation of the above-mentioned apparatus is described with reference to FIG. 7.

Pump P is driven by engine E, which drives hydraulic motor M, to rotate helical screw 2, sprocket wheels 14*a*, 14*b*, 15*a*, 15*b* and driving mechanism 40.

Chains 13*a*, 13*b* are moved by rotation of the sprocket wheels 14*a*, 14*b*, 15*a*, 15*b* by which holder 16 connected with the chains through pin 17 travels to an entrance hole portion of the partitioning plate, at which roller 22 of partitioning plate 5*a* is moved downward by engaging part 30 of piston 31 of crank mechanism $C_1$, while helical screw 2 is rotated. Partitioning plates 5 enter between adjacent blade sections 2*a*, 2*b* of the helical screw with rotation of the screw, and slidably move in an axial direction along longitudinal groove 3. Partitioning plates 5, partition the helically extending space on helical screw 2 into plural sections, with the partitioned space moving forward with rotation of helical screw 2. Each partitioning plate 5 scrapes pressurized material stuck to helical screw 2 off. Therefore, the screw pump is free of clogging, thus securely feeding material.

When holder 16 is inserted into the entrance hole portion, roller 22 moves upward by engaging part 30 of piston 33 of crank mechanism $C_3$ disposed at the exit hole portion thereof. Thereby the partitioning plates depart from between adjacent sections 2*a*, 2*b* of helical screw 2 and the partitioning plate is advance toward the entrance hole portion by means of chains 13*a*, 13*b*.

When trouble such as clogging occurs during the operation of the above-mentioned apparatus, all of pistons 31, 32, 33 of crank mechanisms $C_1$, $C_2$, $C_3$ are raised so that all partitioning plates 5, are pushed up. This makes checking and repairs of the apparatus easy, thereby suitable restoration of the apparatus is possible.

This invention is not to be limited to the embodiments shown in the drawings and described in the description, which is given by way of example and not of limitation, but only in accordance with the scope of the appended claims.

What is claimed is:

1. In a screw pump comprising: an outer cylinder having a linear central axis, a cylindrical wall, and an axially extending groove formed in said wall; a helical screw having a shaft extending axially inside said cylinder; drive means for driving said helical screw; a plurality of partitioning plates axially slidably fitting said groove and movable with said helical screw in the direction of the axis of said shaft and restrained against movement in a direction around said axis; said plurality of partitioning plates constructed and arrange to engage said helical screw and fit between adjacent sections of said helical screw so that they move axially and not rotatably when said helical screw is rotated around its axis, whereby adjacent sections are partitioned from each other by said plates to prevent clogging of said pump, the improvement comprising: revolving chains for moving said partitioning plates in the direction of the axis of said shaft of said helical screw; holders for holding said partitioning plates so that said partitioning plates can slidably move, each of said holders being connected to said revolving chains by connecting means; sliding plates vertically slidable fitted in respective holders and connected with corresponding partitioning plates; a plurality of blocks vertically slidable to fit in a vertical groove formed in each sliding plate; each of said blocks having a projection; hydraulic cylinders for vertically moving respective sliding plates each having a piston connected with said projection through engaging means; and a spring for biasing each corresponding block away from said hydraulic cylinders.

2. A screw pump as claimed in claim 1 wherein said connecting means is a pin.

3. A screw pump as claimed in claim 1 wherein said screw pump includes a spring interposed between the piston of the hydraulic cylinder and the engaging means.

4. A screw pump as claimed in claim 1 further comprising a sealing plate having an opening for passing each partitioning plate through, said sealing plate being welded to one end of said holder a lower surface of said sealing plate being disposed on and slidable on the circumferential edge of said outer cylinder.

5. A screw pump as claimed in claim 1 wherein said hydraulic cylinders comprise: a first hydraulic cylinder for pushing a partitioning plate into said outer cylinder at the entrance hole portion in said groove, said hydraulic cylinder being mounted on the front side of said partitioning plate and connected with said partitioning plate at the entrance hole portion through said projection and said engaging means; a second hydraulic cylinder for pushing a partitioning plate up at the exit hole portion in said groove of said outer cylinder, said hydraulic cylinder being mounted on the front side of said partitioning plate and connected with said partitioning plate at the exit hole portion through said projection and said engaging means; and a third hydraulic cylinder for pressing partitioning plates situated midway between the entrance hole portion and the exit hole portion, said third hydraulic cylinder being mounted on the front side of said partitioning plates and connected with said partitioning plates situated midway between the entrance hole portion and the exit hole portion through said projections and the engaging means respectively.

6. In a screw pump comprising: an outer cylinder having a linear central axis, a cylindrical wall, and an axially extending groove formed in said wall; a helical screw having a shaft extending axially inside said cylinder; drive means for driving said helical screw; a plurality of partitioning plates axially slidable fitted in said groove and movable with said helical screw in the direction of the axis of said shaft and restrained against movement in a direction around said axis; said plurality of partitioning plates constructed and arranged to engage said helical screw and fit between adjacent sections of said helical screw so that they move axially and not rotatable when the screw is rotated around its axis, whereby adjacent sections are partitioned from each other by said plates to prevent clogging of the pump, the improvement comprising: a pair of sprocket wheels mounted on axes of rotation situated on both ends in said axial direction of the outer cylinder; a pair of chains engaging said sprocket wheels; holders means for holding said partitioning plates so that said partitioning plates can slidably move, each of said holders having a rear portion connected with said pair of chains at the forward side in the direction of progress of said partitioning plates through connecting means; and a guide mounted on the inside of said pair of chains, said guide engaging the rear of said holder means to control the directions of movement of said pair of chains.

7. A screw pump as claimed in claim 6 wherein said connecting means are pins.

8. A screw pump as claimed in claim 6 further comprising; supporting means for supporting the back side of said holder means along the front sides of said chains.

9. In a screw pump comprising: an outer cylinder having a linear central axis, a cylindrical wall, and an axially extending groove formed in said wall, a helical screw having a shaft extending axially inside said cylinder; drive means for driving said helical screw; a plurality of partitioning plates axially slidably fitting said groove so as to be movable with said helical screw in the direction of the axis of said shaft and to be restrained against movement in a direction around said axis; said plurality of partitioning plates constructed and arranged to engage said helical screw and fit between adjacent sections of said helical screw so that they move axially and not rotatably when the screw is rotated around its axis, whereby adjacent sections are partitioned from each other by said plates to prevent clogging of the pump, the improvement comprising: holder means for holding said partitioning plates so that said partitioning plates can slidably move; each of said holder means having roller means on an upper end for slidably moving said partitioning plates and pressing down the upper ends of said holder means.

10. In a screw pump comprising: an outer cylinder having a linear central axis, a cylindrical wall, and axially extending groove formed in said wall, a helical screw having a shaft extending axially inside said cylinder; drive means for driving said helical screw; a plurality of partitioning plates axially slidable fitted in said groove so as to be movable with said helical screw in the direction of the axis of said shaft and restrained against movement in a direction around said axis; said plurality of partitioning plates constructed and arranged to engage said helical screw and fit between adjacent sections of said helical screw so that they move axially and not rotatably when the screw is rotated around its axis, whereby adjacent sections are partitioned from each other by said plates to prevent clogging of the pump, the improvement comprising: revolvable chain means for moving said partitioning plates in the direction of the axis of said shaft of said helical screw; holder means for holding said partitioning plates so that said partitioning plates can be slidably moved, said holder means being connected to said revolvable chain means by connecting means; sliding plates vertically slidable fitting said holder means and connected with a corresponding partitioning plates; block means having a projection being vertically slidable fitted in a vertical groove formed in said sliding plate; crank mechanism means for vertically moving respective sliding plates, said crank mechanism means having a piston connected with said projection through engaging means; and a spring for biasing each corresponding block away from said crank mechanism means.

11. A screw pump as claimed in claim 10 wherein said connecting means is a pin.

12. A screw pump as claimed in claim 10 wherein said spring for biasing each corresponding block comprises a spring interposed between each piston of said crank mechanism means and said engaging means.

13. A screw pump as claimed in claim 10 said further comprising a sealing plate having a trapezoid-shaped opening formed therein for passing a partitioning plate therethrough, said sealing plate being welded to one end of said holder, a lower surface of said sealing plate being disposed on and slidable on the circumferential edge of said outer cylinder.

14. A screw pump as claimed in claim 10 wherein said crank mechanism means comprise: a first crank mechanism for pushing each partitioning plate into the outer cylinder at the entrance hole portion in the groove of the outer cylinder, said first crank mechanism being mounted on the front side of a partitioning plate and connected with said partitioning plate at the entrance hole portion through said projection and said engaging means; a second crank mechanism for pushing said partitioning plate into the outer cylinder at the exit hole portion in the groove of the outer cylinder, said second crank mechanism being mounted on the front side of said partitioning plate and connected with said partitioning plate at the exit hole portion through said projection and said engaging means; and a third crank mechanism for pressing on the partitioning plates situated midway between the entrance hole portion and the exit hole portion, said third crank mechanism being mounted on the front side of the partitioning plates and connected with the partitioning plates situated midway between the entrance hole portion and the exit hole portion through said projection and the engaging means, respectively.

15. In a screw pump comprised of; an outer cylinder having a cylindrical wall and an axis; said outer cylinder having an axially extending groove in said wall; a helical screw having a shaft mounted inside and coaxial with said outer cylinder; drive means for rotatably driving said helical screw; a plurality of partitioning plates fitting said axially extending groove in said outer cylinder, said partitioning plates being slidable parallel to the axis of said cylinder and movable with said helical screw and restrained against movement around the axis of said shaft in said helical screw; said plurality of partitioning plates being constructed and arranged to engage the space between adjacent portions of the blade of said helical screw to move axially with rotation of said helical screw whereby adjacent sections between blade portions of said helical screw are partitioned from one another to prevent a clogging of said helical screw; the improvement comprising; revolving chain means; holder means attached to said revolving chains means for revolving with said chain in the direction of the axis of said helical screw; mounting plate means mounting said partitioning plates on said holder means, said mounting plate means being slidable perpendicular to the axis of a said helical screw; block means being mounted in a vertical groove in said mounting plate means; each of said block means having roller means; hydraulic cylinder means for moving said mounting plate means and said partitioning plates perpendicular to the axis of said helical screw; said hydraulic cylinder means being connected to said mounting plate means by engaging means engaging said roller means; and resilient biasing means between said hydraulic cylinder piston means and said slidable block means.

16. The screw pump according to claim 15 in which said resilient biasing means comprises spring means interposed between said block means and said mounting plate means.

17. The screw pump according to claim 15 in which said resilient biasing means comprises spring means between said hydraulic cylinder piston means and said engaging means.

18. The screw pump according to claim 15 including; a sealing plate attached to a lower end of said roller means; said sealing plate having an opening for said partitioning plate to pass through; said sealing plate being attached so that its lower surface is disposed on and slidable on a circumferential edge of said outer cylinder.

19. The screw pump according to claim 15 in which said hydraulic cylinder means comprise; at least three hydraulic cylinders; the first and last hydraulic cylinders being mounted next to the beginning and end of said groove in said outer cylinder for pushing said partitioning plates into or out of engagement with said helical screw respectively; and an intermediate hydraulic cylinder for engagement with all partitioning plates in said groove intermediate the beginning and end of said groove for simultaneously pushing all intermediate partitioning plates into or out of engagement with said helical screw.

20. In a screw pump comprised of; an outer cylinder having a cylindrical wall and an axis, said outer cylinder having an axially extending groove in said wall; a helical screw having a shaft mounted inside and coaxial with said outer cylinder; drive means for rotatably driving said helical screw; a plurality of partitioning plates fitting said axially extending groove in said outer cylinder, said partitioning plates being slidable parallel to the axis of said cylinder and movable with said helical screw and restrained against movement around the axis of said shaft in said helical screw; said plurality of partitioning plates being constructed and arranged to engage the space between adjacent portions of the blade of said helical screw to move axially with rotation of said helical screw whereby adjacent sections between blade partitions of said helical screw are partitioned from one another to prevent clogging of said helical screw; the improvement comprising; a pair of sprocket wheels rotatably mounted adjacent each end of said groove in said outer cylinder; a revolvable chain mounted on said sprocket means; partitioning plate holder means connected to and revolvable with said revolvable chain; said partitioning plate being slidably attached to said holder means for sliding into or out of engagement with said helical screw; connecting means connecting said holder means to said revolvable chain; said connecting means extending to behind said revolvable chain; and guide means mounted behind said revolvable chain engaging said holder means to guide said holder means in the direction of revolution of said revolvable chain.

21. The screw pump according to claim 20 in which said connecting means comprises a pin passing through an extension on said holder means and said revolvable claim.

22. In a screw pump comprise of; an outer cylinder having a cylindrical wall and an axis, said outer cylinder having an axially extending groove in said wall, a helical screw having a shaft; said helical screw being mounted inside and coaxially with said outer cylinder; drive means for rotatably driving said helical screw; a plurality of partitioning plates fitting said axially extending groove in said outer cylinder, said partitioning plates being slidable parallel to the axis of said cylinder and movable with said helical screw and restrained against movement around the axis of said shaft in said helical screw; said plurality of partitioning plates being constructed and arranged to engage the space between adjacent portions of the blade of said helical screw to move axially with rotation of said helical screw whereby adjacent sections between blade portions of said helical screw are partitioned from one another to prevent a clogging of said helical screw; the improvement comprising; revolvable chain means; holder means attached to said revolvable chain means for revolving with said revolvable chain in the direction of the axis of said helical screw; mounting plate means mounting said partitioning plates on said holder means, said mounting plate means being slidable perpendicular to the axis of said helical screw; block means being mounted in a vertical groove in said mounting plate means; said block means having roller means; crank means for moving said partitioning plates perpendicular to said helical screw, said crank means being connected to said roller means in said block means by engaging means; and resilient biasing means between said crank means and said slidable block means.

23. The screw pump according to claim 22 in which said connecting means connecting said holder means to said revolvable chain means comprises an extension in said holder means engaging said revolvable chain and a pin through said holder means extension and said revolvable chain.

24. The screw pump according to claim 22 in which said resilient biasing means comprises spring means interposed between said block means and said mounting plate means.

25. The screw pump according to claim 22 in which said resilient biasing means comprises spring means between said crank means and said engaging means.

26. The screw pump according to claim 22 including a sealing plate attached to a lower end of said roller means; said sealing plate having an opening for said partitioning plate to pass through; said sealing plate being attached so that its lower surface is disposed on and slidable on a circumferential edge of said outer cylinder.

27. The screw pump according to claim 22 in which said crank means comprises; at least three crank mechanisms; a first and third crank mechanisms being mounted next to the beginning and end of said groove in said outer cylinder for pushing said partitioning plates into or out of engagement with said helical screw respectively; and a second intermediate crank mechanism for engagement with all partitioning plates in said groove intermediate the beginning and the end of said groove in said outer cylinder for simultaneously pushing all intermediate partitioning plates into or out of engagement with said helical screw.

28. A screw pump according to claim 1 in which said projection on each of said plurality of blocks includes roller means.

29. A screw pump according to claim 28 in which said spring is interposed between said sliding plates and each of said plurality of blocks.

30. A screw pump according to claim 5 in which said projection on each of said plurality of blocks includes roller means.

31. A screw pump according to claim 30 in which said spring is interposed between said sliding plates and each of said plurality of blocks.

32. A screw pump according to claim 10 in which said projection on each of said plurality of blocks includes roller means.

33. A screw pump according to claim 32 in which said spring is interposed between said sliding plates and each of said plurality of blocks.

* * * * *